US009880488B2

(12) United States Patent
Mori

(10) Patent No.: US 9,880,488 B2
(45) Date of Patent: Jan. 30, 2018

(54) IMAGE FORMING APPARATUS SELECTIVELY ELIMINATING CHARGE DEPENDING ON IMAGE CONTENT

(71) Applicant: FUJI XEROX CO., LTD., Tokyo (JP)

(72) Inventor: Mitsuhiro Mori, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,285

(22) Filed: Sep. 6, 2016

(65) Prior Publication Data

US 2017/0277062 A1 Sep. 28, 2017

(30) Foreign Application Priority Data

Mar. 28, 2016 (JP) ..... 2016-064346

(51) Int. Cl.
*G03G 15/02* (2006.01)
*G03G 21/08* (2006.01)

(52) U.S. Cl.
CPC ..... *G03G 15/0275* (2013.01); *G03G 21/08* (2013.01)

(58) Field of Classification Search
CPC ..... G03G 2215/0448–2215/0458
See application file for complete search history.

(56) References Cited

U.S. PATENT DOCUMENTS 4,365,885 A * 12/1982 Nishikawa ..... G03G 15/047 355/71
4,847,657 A * 7/1989 Hanada ..... G03G 15/047 399/187
6,070,032 A * 5/2000 Rokutanda ..... G03G 21/08 399/128
6,376,141 B1 * 4/2002 Mishra ..... G03G 5/047 430/129
8,364,054 B2 * 1/2013 Mihai ..... G03G 15/2025 399/327

FOREIGN PATENT DOCUMENTS

JP 61184584 A * 8/1986 ..... G03G 15/169
JP H11-30395 A 2/1999
JP 2002-072796 A 3/2002
JP 2005-031111 A 2/2005
JP 2008-299255 A 12/2008

* cited by examiner

*Primary Examiner* — Sevan A Aydin
(74) *Attorney, Agent, or Firm* — Oliff PLC

(57) ABSTRACT

An image forming apparatus includes: a photoconductor; an electric charging device charging the photoconductor; an exposure device exposing a portion of the photoconductor charged by the electric charging device to light based on image information, to form an electrostatic latent image; a first charge eliminating device emitting light to the photoconductor so as to eliminate an electric charge on a surface of the photoconductor; a second charge eliminating device emitting light to the photoconductor so as to eliminate an electric charge on a surface of the photoconductor, a wavelength of the light emitted by the first charge eliminating device being different from a wavelength of the light emitted by the second charge eliminating device; and a controller selectively operating the first and second charge eliminating devices depending on an image content of the electrostatic latent image in an image forming process.

4 Claims, 4 Drawing Sheets

IMAGE FORMING APPARATUS SELECTIVELY ELIMINATING CHARGE DEPENDING ON IMAGE CONTENT

CROSS-REFERENCE TO RELATED APPLICATIONS

This application is based on and claims priority under 35 USC 119 from Japanese Patent Application No. 2016-064346 filed Mar. 28, 2016.

BACKGROUND

The present invention relates to an image forming apparatus.

SUMMARY

According to an aspect of the invention, an image forming apparatus includes: a photoconductor; an electric charging device that charges the photoconductor; an exposure device that exposes a portion of the photoconductor charged by the electric charging device to light based on image information, to form an electrostatic latent image; a first charge eliminating device that emits light to the photoconductor so as to eliminate an electric charge on a surface of the photoconductor; a second charge eliminating device that emits light to the photoconductor so as to eliminate an electric charge on a surface of the photoconductor, a wavelength of the light emitted by the first charge eliminating device being different from a wavelength of the light emitted by the second charge eliminating device; and a controller that selectively operates the first charge eliminating device and the second charge eliminating device depending on an image content of the electrostatic latent image formed by the exposure device in an image forming process.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the present invention will be described with reference to the drawings.

First Exemplary Embodiment

Figure 1:
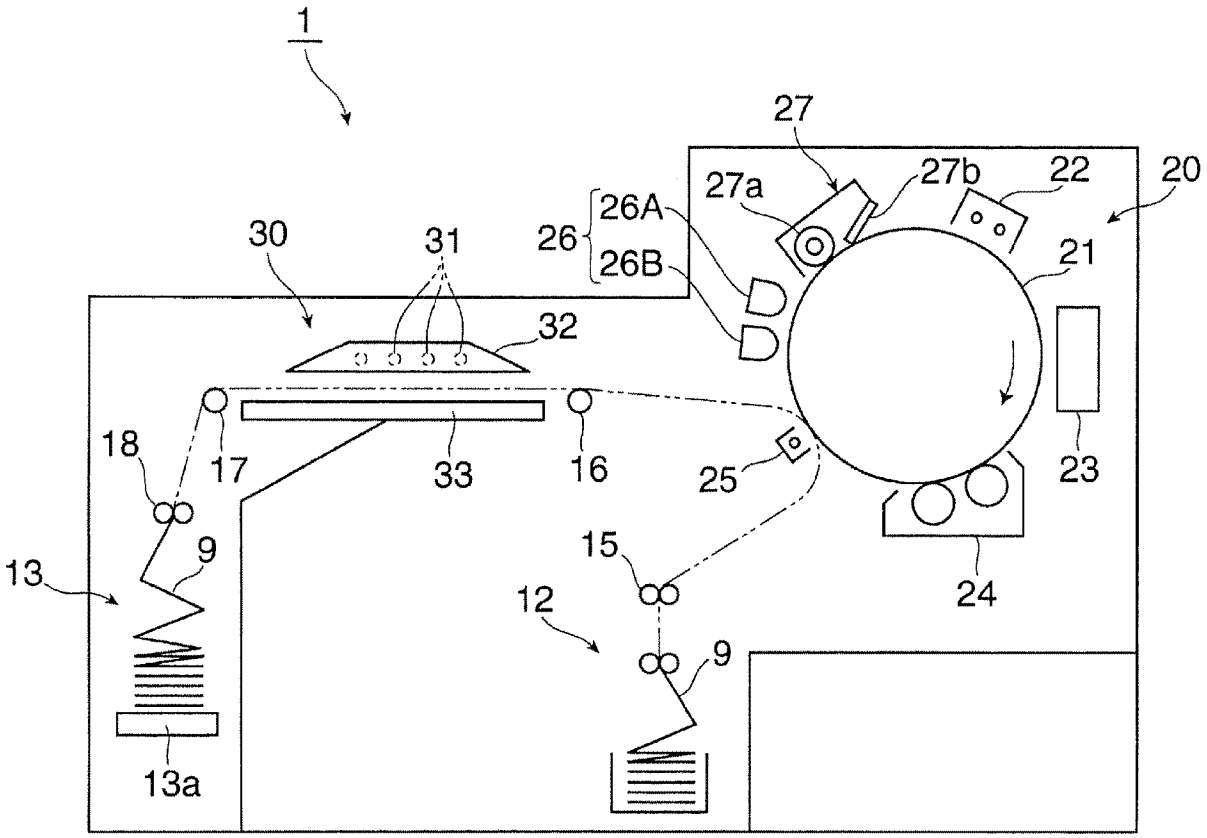
FIG. 1 is a conceptual view illustrating an outline of an image forming apparatus according to first exemplary embodiment.
Figure 2:
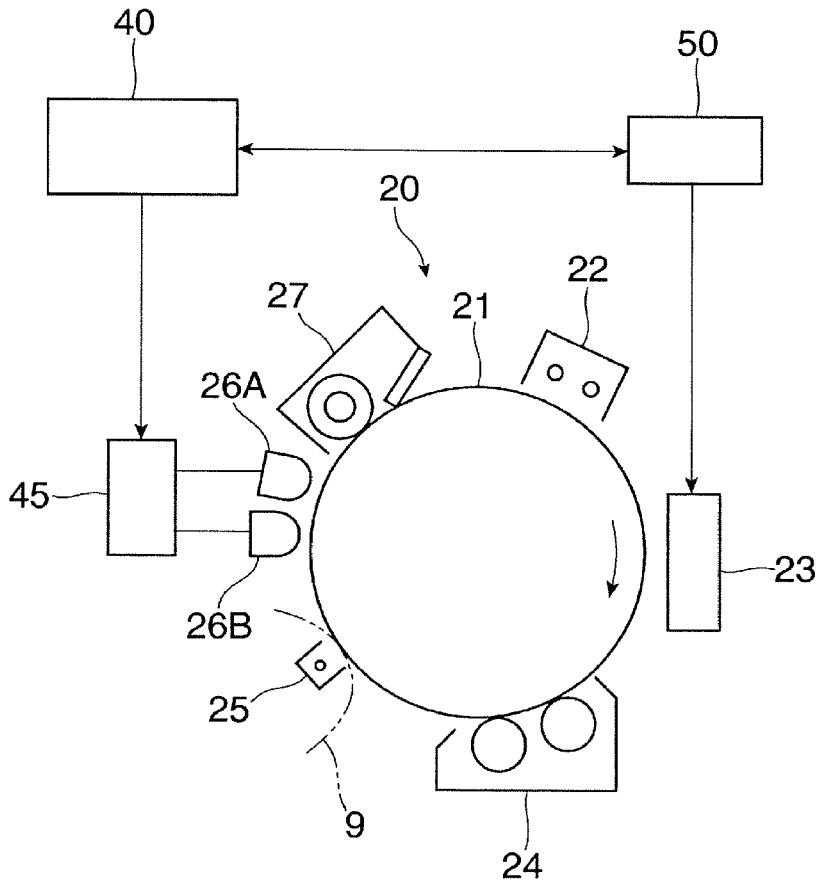
FIG. 2 is an explanatory view illustrating a part of the image forming apparatus of FIG. 1 (two charge eliminating devices and related portions thereof)

FIGS. 1 and 2 illustrate an image forming apparatus according to a first exemplary embodiment. FIG. 1 illustrates an outline of the entire image forming apparatus, and FIG. 2 illustrates a part of the image forming apparatus (two charge eliminating devices and related portions thereof).

<Entire Configuration of Image Forming Apparatus>

An image forming apparatus 1 according to the first exemplary embodiment is an apparatus that forms an image composed of a toner on a continuous paper 9, in which a perforation line is preliminarily formed, as a recording medium.

In the image forming apparatus 1, as illustrated in FIG. 1, an image is formed in the manner that the continuous paper 9 in a state of being folded zigzag is continuously sent out from a feed section 12, and then, transported via an image forming section 20 configured to form a toner image on the continuous paper 9 and a fixing section 30 configured to fix the toner image on the continuous paper 9, in this order, so that an image is formed on the continuous paper 9. Finally, the continuous paper 9 formed with the image is accommodated in the state of being folded zigzag in an accommodating section 13. In FIG. 1, the one-long and two-short dashed line represents a main transport path of the continuous paper 9, which is configured with plural transport rolls 15 to 18, a transport guide material (not illustrated), or the like.

The image forming section 20 includes a photoconductor drum 21 driven to rotate in a predetermined direction (in the direction indicated by the arrow). An electric charging device 22, an exposure device 23, a developing device 24, a transfer device 25, a charge eliminating device 26, and a cleaning device 27 are disposed around the photoconductor drum 21.

Of these components, for the photoconductor drum 21, a photoconductor is used which is made in a drum form by using, for example, amorphous silicon which is an inorganic-based photoconductive material. Since the photoconductor made of amorphous silicon has a characteristic of being hardly worn due to high surface hardness thereof, the photoconductor is excellent in stability and durability and suitable for a high-speed continuous image formation.

The electric charging device 22 uniformly changes the circumferential surface of the photoconductor drum 21. As the electric charging device 22, for example, a corona discharge type electric charging device is used. As the corona discharge type electric charging device, a so-called scorotron which has a grid in addition to a discharge wire is used.

The exposure device 23 exposes the charged circumferential surface of the photoconductor drum 21 to light based on image information input from the outside, so as to form an electrostatic latent image. When the photoconductor drum 21 is made of amorphous silicon, for example, a light beam emission device is used as the exposure device 23, in which the light beam emission device emits exposure light having a relatively long wavelength of 700 nm or more (e.g., a light emission wavelength in a range of 710 nm to 745 nm). When the exposure device 23 that emits the light having the long wavelength is used, the electrostatic latent image may be formed at a high speed with a high resolution.

The developing device 24 forms a toner image by supplying a toner as a developer to the circumferential surface of the photoconductor drum 21 in such a manner that the toner is attached to the latent image portion and thus the latent image is developed. As the toner, a required color (i.e., black) is applied.

The transfer device 25 transfers the toner image formed on the photoconductor drum 21 onto the continuous paper 9. As the transfer device 25, for example, a corona discharge type transfer device is used. In this case, the transfer device 25 is disposed to face the transfer position of the photoconductor drum 21 with a transport path of the continuous paper 9 being interposed therebetween.

The charge eliminating device 26 eliminates electric charges present on the circumferential surface of the photoconductor drum 21 by emitting electric discharge light thereto. Details of the charge eliminating device 26 will be described later.

The cleaning device 27 cleans the photoconductor drum 21 by removing an adhered substance such as a toner remaining on the circumferential surface of the photoconductor drum 21 after the transfer. The cleaning device 27 is configured with, for example, a rotating brush 27*a* and a plate shaped member 27*b* which are disposed inside a case. The rotating brush 27*a* rotates in contact with the circumferential surface of the photoconductor drum 21 at the upstream side of the rotational direction thereof. The plate shape member 27*b* is disposed in contact with the circumferential surface of the photoconductor drum 21 at the upstream side of the rotational direction thereof in comparison with the rotating brush 27*a* so as to scrap the adhered substance.

The fixing section 30 fixes an unfixed toner image formed on the continuous paper 9. As the fixing section 30, for example, a fixing device of a flash fixing type is used. The fixing section 30 of the flash fixing type includes plural flash lamps 31 that emit flash light, a case 32 provided with a reflecting surface that reflects the flash light from each of the flash lamps toward the transported continuous paper 9, and a plate shaped transport holding member 33 that holds the transported continuous paper 9 to move in a plane state.

The accommodating section 13 adopts, for example, a configuration in which an accommodating table 13*a* configured to accommodate thereon the continuous paper 9 moves down according to a condition such as an accommodation height when the continuous paper 9 is accommodated on the accommodating table 13*a*. Further, in the accommodating section 13, a swing guide mechanism (not illustrated) is provided above the accommodating table 13*a*. The swing guide mechanism periodically swings from side to side in accordance with a timing at which the perforation lines of the continuous paper 9 that are used for folding and cutting of the continuous paper 9 passes, so as to send the continuous paper 9 downward to the accommodating table 13*a*. In this accommodating section 13, the continuous paper 9 accommodated by the swing guide mechanism is exactly alternately folded along the perforation lines to be stacked on the accommodating table 13*a*.

<Image Forming Operation by Image Forming Apparatus>

In the image forming apparatus 1, when a command requesting an image forming operation is received, the photoconductor drum 21 of the image forming section 20 starts to rotate. The circumferential surface of the photoconductor drum 21 is charged by the electric charging device 22, and thereafter, exposed to the exposure light from the exposure device 23 so that an electrostatic latent image based on image information is formed per page unit. Then, each electrostatic latent image is developed by a toner when passing the developing device 24 to be formed as a toner image.

Meanwhile, the feed section 12 continuously sends out the continuous paper 9 toward the transfer position of the image forming section 20 (the portion facing the transfer device 25 of the photoconductor drum 21) in accordance with the operation of the image forming section 20.

Then, in the image forming section 20, each toner image formed on the photoconductor drum 21 is transferred onto the continuous paper 9 (onto one page unit area interposed between front and rear perforation lines) in response to the transfer operation of the transfer device 25. After the transfer, the circumferential surface of the photoconductor drum 21 is discharged by the charge eliminating device 26, and then, cleaned by the cleaning device 27 so as to prepare the next image forming process.

Subsequently, the continuous paper 9 having the transferred toner image is sent out from the image forming section 20 and transported to pass the fixing section 30. In the fixing section 30, the flash lamps 31 are turned on so that flash light is emitted toward the continuous paper 9. Accordingly, the toner forming the toner image on the continuous paper 9 passing the fixing section 30 is melted and the toner image is fixed.

Finally, the continuous paper 9 having the fixed toner image is sent from the fixing section 30, and thereafter, accommodated to be stacked in the state of being folded zigzag in the accommodating section 13.

In this way, a required image formed with a toner is continuously formed one side of the continuous paper 9 at each page.

Additionally, in the image forming apparatus 1, since the continuous paper 9 is continuously transported in a series without being cut during the image forming operation, unlike cut papers cut in advance into a required size, the continuous paper 9 may be transported at a high speed, as compared to the case of forming an image on the cut papers. When the continuous paper 9 is transported at a high speed, the image forming apparatus 1 may perform the image formation at a high speed, as compared to the apparatus of forming an image on the cut papers.

<Configuration of Charge Eliminating Device>

Next, the charge eliminating device 26 in the image forming section 20 will be described.

As illustrated in FIG. 1 or FIG. 2, the charge eliminating device 26 includes the two charge eliminating devices, that is, a first charge eliminating device 26A and a second charge eliminating device 26B. The first and second charge eliminating devices 26A, 26B emit light having different light emission wavelengths to eliminate electric charges on the circumferential surface of the photoconductor drum 21.

The first charge eliminating device 26A is configured as a device including a light source capable of emitting light to suppress an exposure memory which causes an afterimage phenomenon (so-called ghost), as compared to the second charge eliminating device 26B. Specifically, the first charge eliminating device 26A is configured as a device including a light source that emits light having a wavelength close to a light emission wavelength of exposure light emitted by the exposure device 23, as compared to the second charge eliminating device 26B. The light emission wavelength of the light emitted by the first charge eliminating device 26A has, for example, 700 nm at a peak wavelength.

Meanwhile, the second charge eliminating device 26B is configured as a device including a light source capable of emitting electric discharge light to a sufficient degree enough to eliminate electric charges remaining on the circumferential surface of the photoconductor drum 21 and to make the surface potential of the photoconductor drum 21 substantially even. Specifically, the second charge eliminating device 26B is configured as a device including a light source capable of emitting light having a shorter wavelength than the light emission wavelength of the first charge eliminating device 26A. The light emission wavelength of the light emitted by the second charge eliminating device 26B has, for example, 660 nm at a peak wavelength.

The first charge eliminating device 26A and the second charge eliminating device 26B may be any charge eliminating device may be used as long as it includes a light source that emits light meeting the above-described condition for the light emission wavelength. However, it is preferable to use a charge eliminating device in which plural solid color light emitting diodes (LEDs) are arranged side by side in a row along the rotational axis of the photoconductor drum 21. In the first exemplary embodiment, as a material (semiconductor) for the LEDs, GaP (peak wavelength: 700 nm) is used for the first charge eliminating device 26A, and GaAlAs (peak wavelength: 660 nm) is used for the second charge eliminating device 26B. Here, the light emission wavelength of each LED may be measured by using, for example, a spectroradiometer. In addition, the light emission wavelength is an emitted light center wavelength which becomes a center of a wavelength (spectrum) distribution. In the above, Ga represents gallium, P represents phosphorus, Al represents aluminum, and As represents arsenic.

Figure 3:
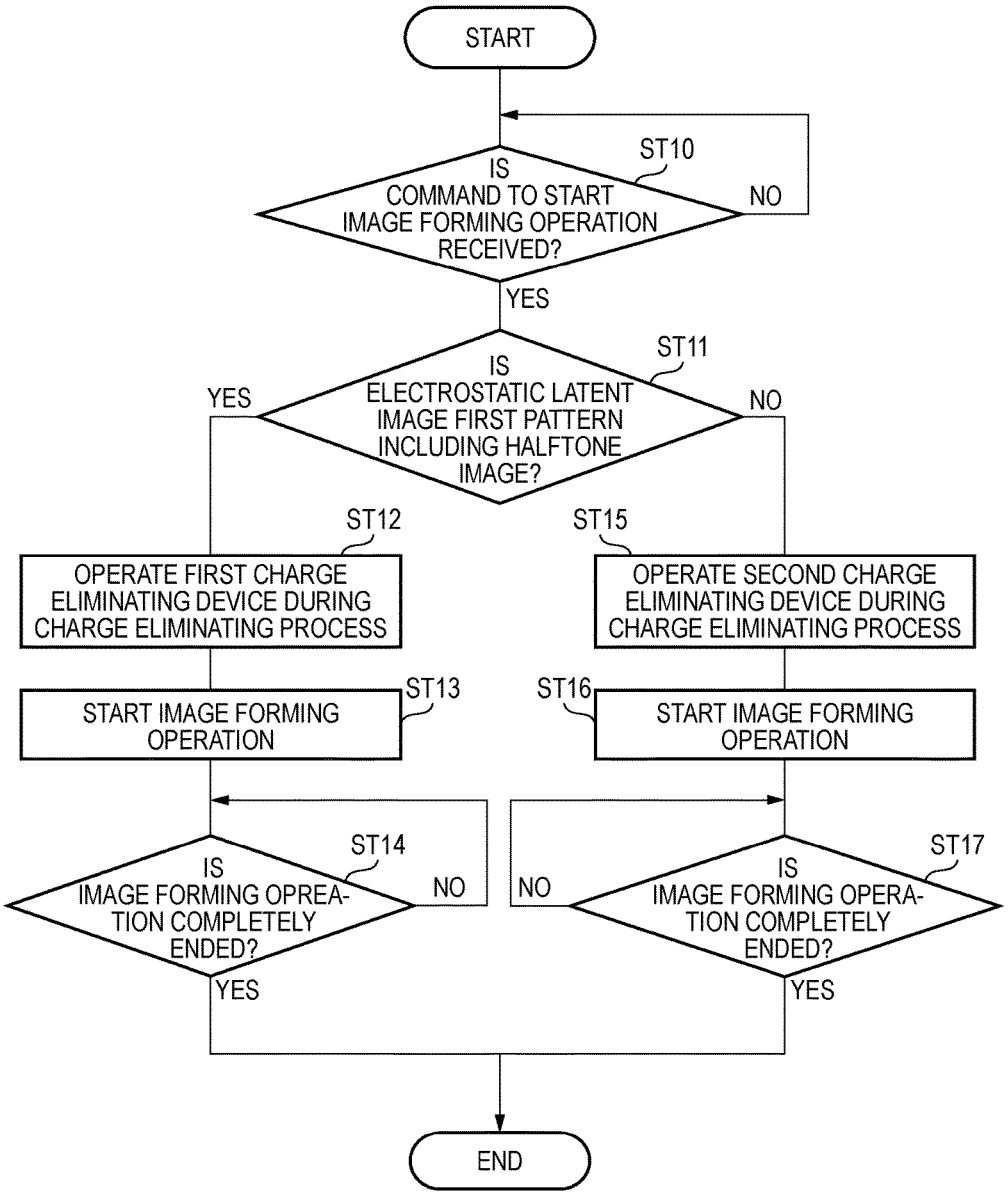
FIG. 3 is a flowchart illustrating control contents for operations of the two charge eliminating devices in the image forming apparatus of FIG. 1.

In addition, as illustrated in FIG. 2 or FIG. 3, the first charge eliminating device 26A and the second charge eliminating device 26B are configured to be selectively operated by a controller 40 depending on an image content of an electrostatic latent image formed by the exposure device 23 at the time of the image forming process.

In the first exemplary embodiment, as illustrated in FIG. 3, the controller 40 operates the first charge eliminating device 26A when the image content of the electrostatic latent image is a first pattern including a halftone image, and operates the second charge eliminating device 26B when the image content of the electrostatic latent image is a second pattern including no halftone image. The halftone image means an image having an image density of less than 100%. In addition, the image of the second pattern including no halftone image means an image formed of, for example, characters, line drawings, and a combination thereof.

The controller 40 may be a control device including, for example, a central arithmetic processing device, a storage device, and an input/output device. The controller 40 is configured as a part of a central control device configured to control the entire operation of the image forming apparatus 1 or an independent control device. In addition, as exemplified in FIG. 2, the controller 40 is connected to at least an image processing section (image processing device) 50 and a charge-elimination driving device 45. The image processing section 50 is configured to perform a required image processing with respect to image information input from the outside of the image forming apparatus 1, and transmit an image signal after the image processing as information of a latent image to the exposure device 23. The charge-elimination driving device 45 switches and operates the first charge eliminating device 26A and the second charge eliminating device 26B. In practice, the charge-elimination driving device is configured as a power supplying device that switches and supplies required powers for operating the light sources. Besides, the controller 40 is configured such that information necessary for controls, such as information of a main power supply status and a presence/absence or status of an image forming operation, is input (transmitted) to the controller 40 from required components.

In addition, the controller 40 is configured to transmit a control signal required for the operation of the image processing section 50 to the image processing section 50, and receive information about the image content of the electrostatic latent image from the image processing section 50. The information about the image content of the electrostatic latent image is information capable of identifying any one of the first pattern including a halftone image and the second pattern including no halftone image as described above. Further, at the time of the image forming process in which the image forming operation by the image forming apparatus 1 is performed, as illustrated in FIG. 2, the controller 40 performs a control such that the charge eliminating devices used for the charge eliminating process performed in the image forming process is selectively used depending on whether the image content of the electrostatic latent image formed by the exposure device 23 is the first pattern or the second pattern. That is, the controller 40 performs a control such that any one of the first charge eliminating device 26A and the second charge eliminating device 26B is selectively used depending on the image content.

<Operation of Charge Eliminating Device>

Hereinafter, the operations of the first charge eliminating device 26A and the second charge eliminating device 26B will be described.

In the image forming apparatus 1, as illustrated in FIG. 2, when receiving a command to start the image forming operation (ST10), the controller 40 determines whether or not the image content of the electrostatic latent image formed by the exposure of the exposure device 23 is the first pattern including a halftone image (ST11). At this time, the controller 40 receives the information about the image content from the image processing section 50 to make the determination.

In ST11, when it is determined that the image content is the first pattern, the controller 40 controls the charge-elimination driving device 45 to operate the first charge eliminating device 26A as a charge eliminating device during the charge eliminating process (ST12). Then, the required image forming operation is started by the image forming apparatus 1 (ST13). In the image forming operation, the charge eliminating process for the photoconductor drum 21 after the transfer is performed by the first charge eliminating device 26A. Then, the image forming operation is continued until all the required contents are terminated (ST14).

In a case where an image composed of the image content of the first pattern is formed, when a halftone image of the first pattern is formed to overlap with the circumferential surface portion of the photoconductor drum 21 where an image other than a halftone image (e.g., characters) is formed in a previous image forming operation, an afterimage phenomenon may easily occur so that the image, other than a halftone image, that is formed in the previous image forming operation lightly appears within the halftone image of the first pattern.

However, in this image forming process, the charge eliminating process performs the electric discharge by the first charge eliminating device 26A to emit light having a wavelength close to the light emission wavelength of the exposure device 23. Hence, in this charge eliminating process, the electric discharge light emitted by the first charge eliminating device 26A reaches the same depth of the photoconductive layer of the photoconductor drum 21 as that at the exposing time. Thus, the electric charges on the circumferential surface of the photoconductor drum 21 are eliminated so that the surface potential of the photoconductor drum 21 easily becomes an even potential. Accordingly, the occurrence of the afterimage phenomenon is suppressed despite that the image composed of the image content of the first pattern including a halftone image is formed.

Especially, in the image forming apparatus 1, the photoconductor made of amorphous silicon is used. Thus, there is the tendency that the exposure light of the exposure device 23 easily deeply reaches the photoconductive layer of the photoconductor drum 21 so that the exposure memory remains therein. However, when the electric discharge is performed by the first charge eliminating device 26A having the above-described light emission wavelength, the deterioration of the surface potential due to the exposure memory is suppressed.

Meanwhile, in ST11, when it is determined that the image content is not the first pattern (that is, it is determined that the image content is the second pattern), the controller 40 controls the charge-elimination driving device 45 to operate the second charge eliminating device 26B as a charge eliminating device during the charge eliminating process (ST15). Then, the required image forming operation is started by the image forming apparatus 1 (ST16). In the image forming operation, the charge eliminating process for the photoconductor drum 21 after the transfer is performed by the first charge eliminating device 26A. Then, the image forming operation is continued until all the required contents are terminated (ST17).

When the image composed of the image content of the second pattern is formed, no halftone image is formed to overlap with the circumferential surface portion of the photoconductor drum 21 where an image other than a halftone image is formed in a previous image forming operation. Therefore, there is no possibility that the after-image phenomenon occurs. Hence, the occurrence of the afterimage phenomenon is suppressed even though the charge eliminating process is performed by the second charge eliminating device 26B which emits light having a shorter wavelength than the light emission wavelength of the first charge eliminating device 26A.

Second Exemplary Embodiment

Figure 4:
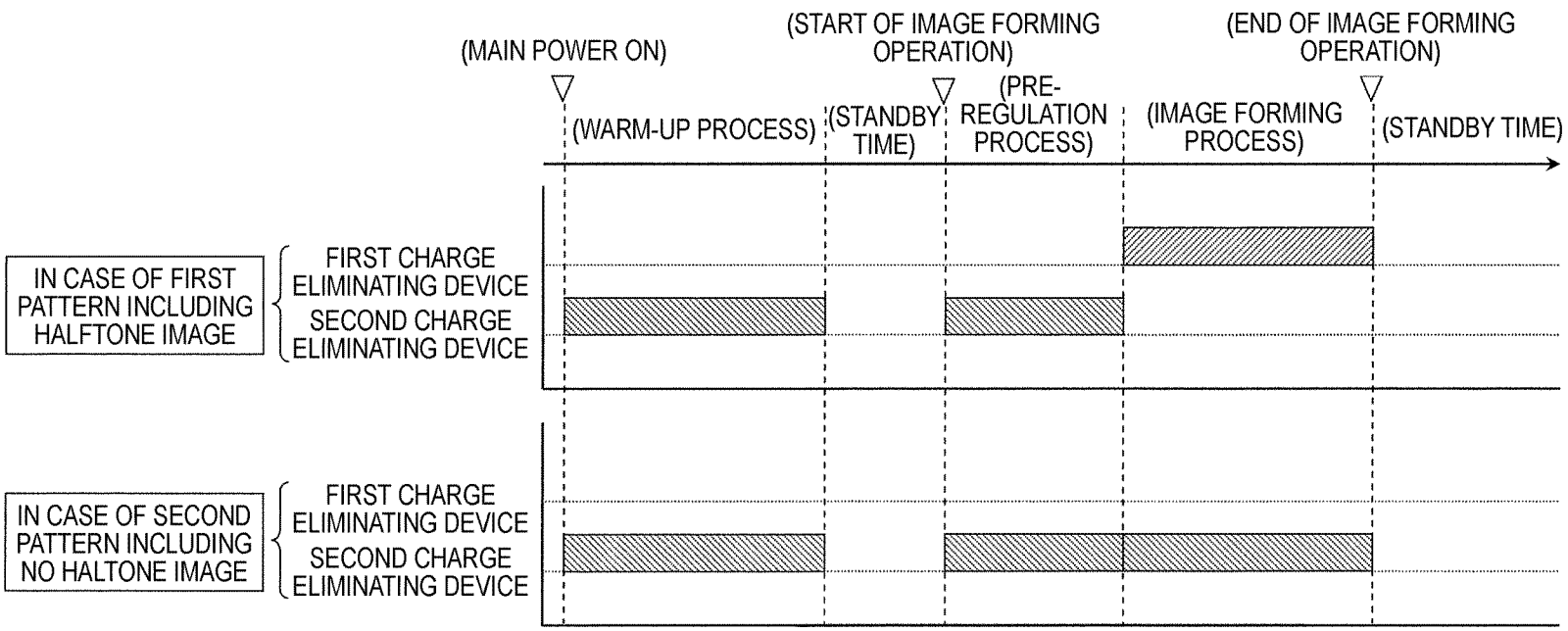
FIG. 4 is an explanatory view illustrating operation states of the two charge eliminating devices in an image forming apparatus according to second exemplary embodiment.

FIG. 4 illustrates operation contents of an image forming apparatus according to a second exemplary embodiment.

An image forming apparatus 1 according to the second exemplary embodiment has the same configuration as that of the image forming apparatus 1 according to first exemplary embodiment, except that the second exemplary embodiment further includes the configuration in which the controller 40 operates the second charge eliminating device 26B during a preparation process prior to the start of the image forming process.

Here, the preparation process includes, for example, a warm-up operation process performed after a main power is supplied to the image forming apparatus 1, a pre-regulation operation process performed immediately prior to the start of the image forming operation, or a post-regulation operation process performed immediately after the end of the image forming operation. In addition, the preparation process has no factor which causes the afterimage phenomenon occurrence. Hence, in this image forming apparatus 1, the charge elimination by the second charge eliminating device 26B is performed during the preparation process. FIG. 4 represents the time period in which the first charge eliminating device 26A or the second charge eliminating device 26B is operated, in a hatched portion. The time periods having no hatched portion represent that neither the first charge eliminating device 26A nor the second charge eliminating device 26B is operated.

Other Exemplary Embodiments

The first and second exemplary embodiments illustrate the exemplary configuration in which both the first charge eliminating device 26A and the second charge eliminating device 26B adopt LEDs as light sources. However, any other type of a light source may be used as long as light having a required light emission wavelength can be obtained from the light sources. In addition, since an LED easily generates light of a single wavelength, there is an advantage in constituting a charge eliminating device including a light source emitting light of a required light emission wavelength.

Besides, the image forming apparatus may be an apparatus that forms an image on cut papers as a recording medium. As the photoconductor, a photoconductor made of photoconductive materials other than the amorphous silicon exemplified in the first exemplary embodiment may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photoconductor;

an electric charging device that charges the photoconductor;

an exposure device that exposes a portion of the photoconductor charged by the electric charging device to light based on image information, to form an electrostatic latent image;

a first charge eliminating device that emits light to the photoconductor so as to eliminate an electric charge on a surface of the photoconductor;

a second charge eliminating device that emits light to the photoconductor so as to eliminate an electric charge on a surface of the photoconductor, a wavelength of the light emitted by the first charge eliminating device being different from a wavelength of the light emitted by the second charge eliminating device; and a controller that selectively operates only one of the first charge eliminating device and the second charge eliminating device depending on an image content of the electrostatic latent image formed by the exposure device in an image forming process.

2. The image forming apparatus of claim 1, wherein the wavelength of the light emitted by the first charge eliminating device is closer to a wavelength of the light of the exposure device than the wavelength of the light emitted by the second charge eliminating device, and the controller operates the first charge eliminating device when the image content is a first pattern including a halftone image, and operates the second charge eliminating device when the image content is a second pattern including no halftone image.

3. The image forming apparatus of claim 2, wherein the controller operates the second charge eliminating device during a preparation process prior to start of the image forming process.

4. The image forming apparatus of claim 1, wherein the controller operates the second charge eliminating device during a preparation process prior to start of the image forming process.

* * * * *